US009056490B2

(12) United States Patent
Kusuda et al.

(10) Patent No.: US 9,056,490 B2
(45) Date of Patent: Jun. 16, 2015

(54) OPTICAL SCANNING DEVICE

(71) Applicant: Brother Kogyo Kabushiki Kaisha, Nagoya-shi, Aichi-ken (JP)

(72) Inventors: Shinya Kusuda, Nagoya (JP); Jun Mihara, Nagoya (JP); Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/492,164

(22) Filed: Sep. 22, 2014

(65) Prior Publication Data

US 2015/0085052 A1 Mar. 26, 2015

(30) Foreign Application Priority Data

Sep. 24, 2013 (JP) ..... 2013-196954

(51) Int. Cl.

| | |
|---|---|
| ***B41J 2/385*** | (2006.01) |
| ***B41J 2/47*** | (2006.01) |
| ***B41J 2/44*** | (2006.01) |
| ***G03G 15/04*** | (2006.01) |

(52) U.S. Cl.

CPC .. *B41J 2/471* (2013.01); *B41J 2/44* (2013.01); *G03G 15/04045* (2013.01)

(58) Field of Classification Search

USPC ..... 347/118, 129, 134, 231, 233, 241, 243, 347/245, 248, 256, 257, 259, 260, 261

See application file for complete search history.

(56) References Cited

U.S. PATENT DOCUMENTS

| | | | | |
|---|---|---|---|---|
| 5,889,545 | A * | 3/1999 | Rauch et al. | 347/134 |
| 8,804,150 | B2 * | 8/2014 | Iwami et al. | 347/134 |
| 2003/0222967 | A1 * | 12/2003 | Chee et al. | 347/243 |
| 2004/0051771 | A1 * | 3/2004 | Eom et al. | 347/134 |
| 2007/0013763 | A1 * | 1/2007 | Kim et al. | 347/134 |
| 2007/0165101 | A1 * | 7/2007 | Makino | 347/261 |
| 2013/0016171 | A1 | 1/2013 | Nakamura et al. | |

FOREIGN PATENT DOCUMENTS

| | | | |
|---|---|---|---|
| JP | H11-301023 | A | 11/1999 |
| JP | 2013-020031 | A | 1/2013 |

* cited by examiner

*Primary Examiner* — Kristal Feggins
(74) *Attorney, Agent, or Firm* — Banner & Witcoff, Ltd.

(57) ABSTRACT

In an optical scanning device, a first deflector rotates about a first axis in a first direction and deflects light to scan the deflected light, and a second deflector rotates about a second axis parallel to the first axis in a second direction opposite to the first direction and deflects light to scan the deflected light. The light detecting unit detects the light deflected by the first deflector and the light deflected by the second deflector. As viewed in an axial direction along the first and second axes, the light detecting unit is disposed on one side relative to a first line and between second and third lines, the first line passing through the first and second axes, the second line passing through the first axis and being perpendicular to the first line, and the third line passing through the second axis and being perpendicular to the first line.

16 Claims, 12 Drawing Sheets

OPTICAL SCANNING DEVICE

CROSS-REFERENCE TO RELATED APPLICATION

This application claims priority from Japanese Patent Application No. 2013-196954, filed on Sep. 24, 2013, which is incorporated herein by reference in its entirety.

TECHNICAL FIELD

Aspects disclosed herein relate to an optical scanning device for use in an electrophotographic image forming apparatus or the like.

BACKGROUND

A known optical scanning device comprises a light source, a deflector, e.g., a polygon mirror, configured to deflect light emitted from the light source, and a light detector configured to detect the light deflected by the deflector. The light detector is disposed in an upstream position in a scanning direction of the deflected light. In another known scanning device for use in a color printer, four light sources, two polygon mirrors, and four light detectors are disposed in a box-shaped housing.

SUMMARY

Aspects of the disclosure provide an optical scanning device which may comprise a first light source configured to emit first light, a second light source configured to emit second light, a first deflector, a second deflector, and a light detecting unit. The first deflector may comprise a first deflecting member configured to deflect the first light to scan the deflected first light, and a first driver configured to drive the first deflecting member to rotate about a first axis in a first rotation direction. The second deflector may comprise a second deflecting member configured to deflect the second light to scan the deflected second light, and a second driver configured to drive the second deflecting member to rotate about a second axis in a second rotation direction, the second axis being parallel to the first axis, and the second rotation direction being opposite to the first rotation direction. The light detecting unit is configured to detect the first light deflected by the first deflecting member and the second light deflected by the second deflecting member. As viewed in an axial direction along the first axis and the second axis, the light detecting unit is disposed on one side relative to a first line and between a second line and a third line, the first line passing through the first axis and the second axis, the second line passing through the first axis and perpendicular to the first line, and the third line passing through the second axis and perpendicular to the first line.

Aspects of the disclosure also provide an optical scanning device which may comprise a first light source configured to emit first light, a second light source configured to emit second light, a first deflector, a second deflector, and a light detecting unit. The first deflector comprises a first deflecting member configured to deflect the first light to scan the deflected first light in a main scanning direction, and a first driver configured to drive the first deflecting member to rotate about a first axis in a first rotation direction. The second deflector comprises a second deflecting member configured to deflect the second light to scan the deflected second light in the main scanning direction, and a second driver configured to drive the second deflecting member to rotate about a second axis in a second rotation direction, the second axis being parallel to the first axis, and the second rotation direction being opposite to the first rotation direction. The light detecting unit is configured to detect the first light deflected by the first deflecting member and the second light deflected by the second deflecting member. The light detecting unit is disposed on one side in the main scanning direction relative to the first axis and the second axis, and between the first axis and the second axis in a sub-scanning direction which is perpendicular to the main scanning direction.

According to one more aspects of the disclosure, an optical scanning device may have a compact form factor and a reduced number of parts.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Embodiments according to one or more aspects will be described below with reference to the accompanying drawings. The embodiments described below are merely examples. Various changes, arrangements and modifications may be applied therein without departing from the spirit and scope of the disclosure.

First Embodiment

Figure 1:
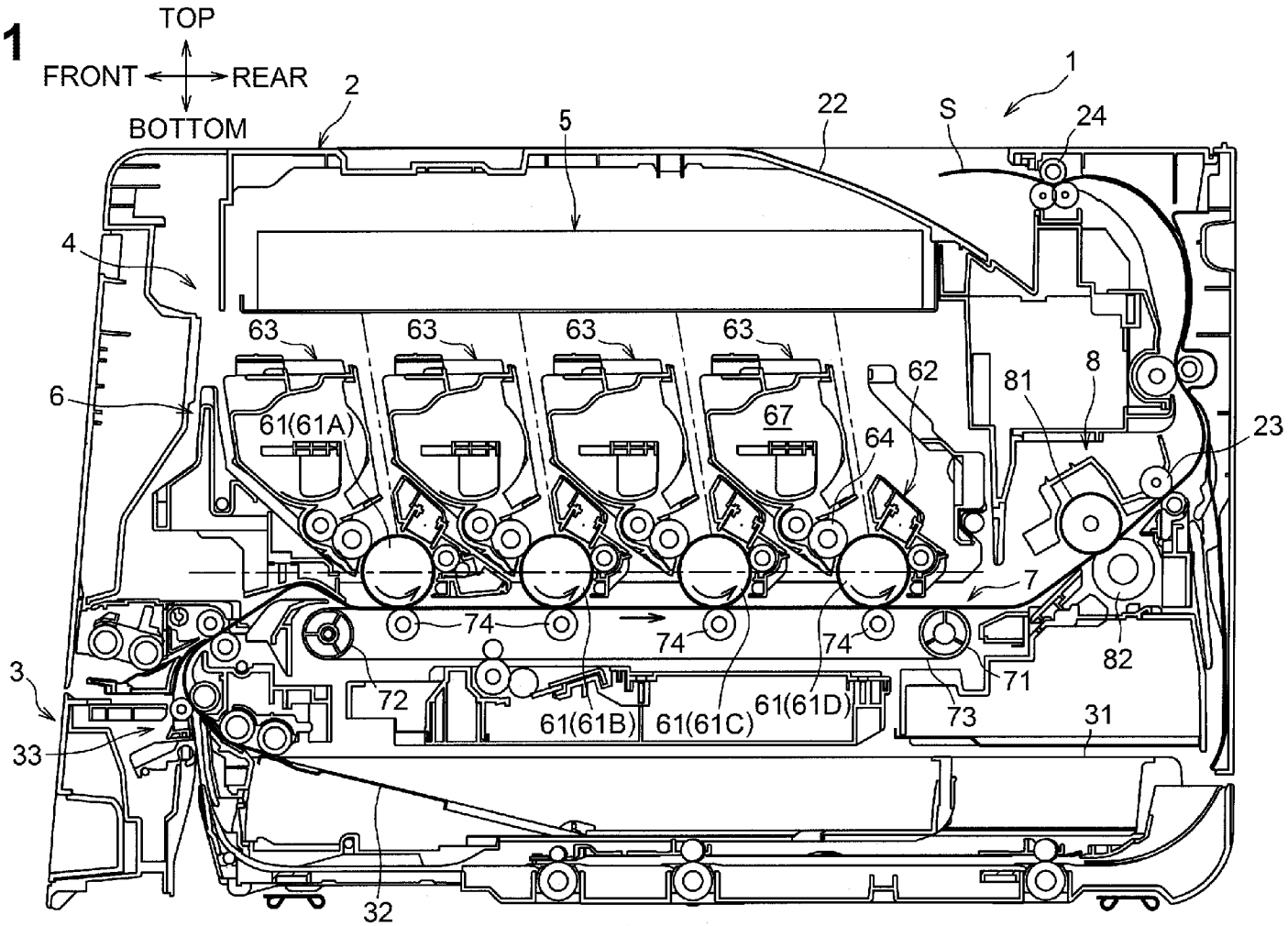
FIG. 1 is a sectional view of an image forming apparatus comprising an optical scanning device in a first embodiment according to one or more aspects of the disclosure.

A first embodiment will be described in detail with reference to the drawings. The overall configuration of an image forming apparatus in which an optical scanning device 5 is used will be described, and thereafter, the configuration of the optical scanning device 5 will be described in detail. In the following description, the directions used to describe the image forming apparatus are based on a user using the apparatus. Specifically, in FIG. 1, the left side in the plane of the drawing is the "front" which is the near side to the user, the right side in FIG. 1 is the "rear" which is the far side from the user, the near side in the plane of the drawing is "right", and the far side in the plane of the drawing is "left". The up and down directions in FIG. 1 are the "vertical" direction.

<Image Forming Apparatus>

A laser printer 1 illustrated in FIG. 1 as an example of an image forming apparatus primarily includes, within a main body casing 2, a sheet feeder 3 which feeds sheets S, and an image forming unit 4 which forms images on the fed sheets S. The image forming unit 4 primarily includes the optical scanning device 5, a process unit 6, a transfer unit 7, and a fixing unit 8.

The sheet feeder 3 is disposed at a lower position in the main body casing 2, and includes a feed tray 31 for accommodating sheets S, a pressing plate 32, and a sheet feeding mechanism 33. Leading edges of the sheets S in the feed tray 31 are urged upwards by the pressing plate 32 and separated by the sheet feeding mechanism 33, and one sheet is fed at a time to the image forming unit 4.

The optical scanning device 5 is disposed at an upper position in the main body casing 2. The optical scanning device 5 is configured to emit a plurality of light beams (see dashed lines) which are to be scanned across photosensitive drums 61, as will be described in detail later.

The process unit 6 is disposed between the feed tray 31 and the optical scanning device 5, and primarily includes four photosensitive drums 61. A charger 62 and a developing unit 63 are provided to each of the photosensitive drums 61. Each developing unit 63 primarily includes a developing roller 64 configured to bear toner, and a toner storage 67 configured to store toner.

The transfer unit 7 is disposed between the feed tray 31 and the process unit 6, and primarily includes a driving roller 71, a driven roller 72, an endless conveying belt 73 stretched between the driving roller 71 and the driven roller 72, and four transfer rollers 74. The conveying belt 73 is disposed such that the outer face thereof comes into contact with the photosensitive drums 61, and that the conveying belt 73 is nipped between the photosensitive drums 61 and the transfer rollers 74 disposed inside the conveying belt 73.

The fixing unit 8 is disposed further toward the rear than the process unit 6 and the transfer unit 7, and primarily includes a heat roller 81, and a pressure roller 82 which is situated facing the heat roller 81 and presses against the heat roller 81.

At the image forming unit 4, the surfaces of the photosensitive drums 61 are uniformly charged by the chargers 62, and thereafter exposed to light beams emitted from the optical scanning device 5 based on image data, whereby electrostatic latent images are formed on the photosensitive drums 61. Toner borne by the developing rollers 64 is supplied to the photosensitive drums 61, thereby forming toner images on the photosensitive drums 61 by visualizing the electrostatic latent images. Thereafter, a sheet S fed from the sheet feeder 3 is conveyed by the conveying belt 73 so as to pass between the photosensitive drums 61 and the transfer rollers 74, thus transferring the toner images on the photosensitive drums 61 onto the sheet S. The sheet S upon which the toner images have been transferred passes between the heat roller 81 and the pressure roller 82, whereby the toner image is thermally fixed, and then the sheet S is discharged by a conveying roller 23 and discharge roller 24 to a discharge tray 22.

<Optical Scanning Device>

Figure 2:
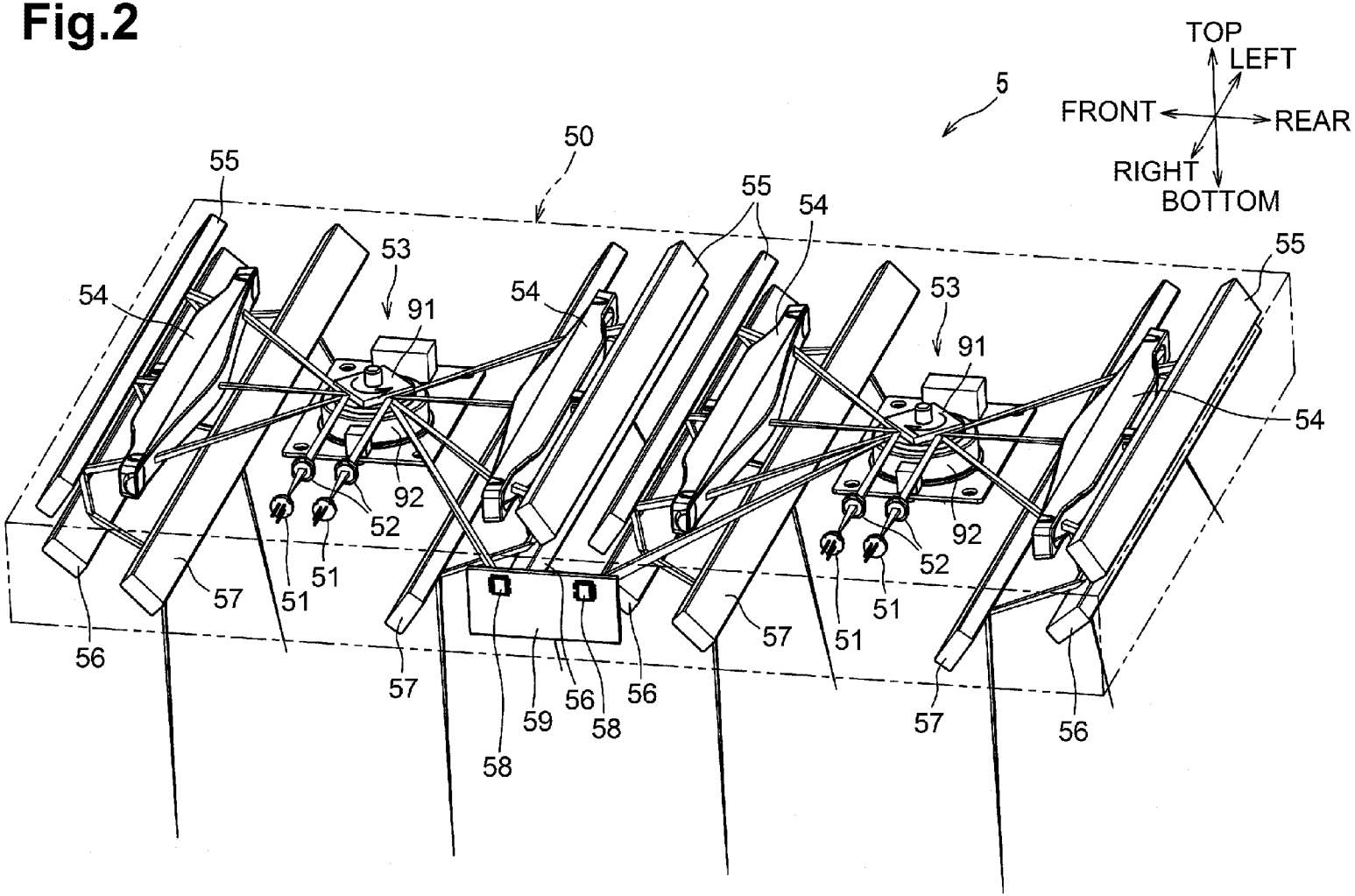
FIG. 2 is a perspective view of the optical scanning device in the first embodiment according to one or more aspects of the disclosure.

The optical scanning device 5 illustrated in FIG. 2 includes, within a box-shaped frame 50, four semiconductor lasers 51, four coupling lenses 52, two deflectors 53, four scanning lenses 54, a plurality of mirrors 55 through 57, and two light detectors 58.

Figure 3:
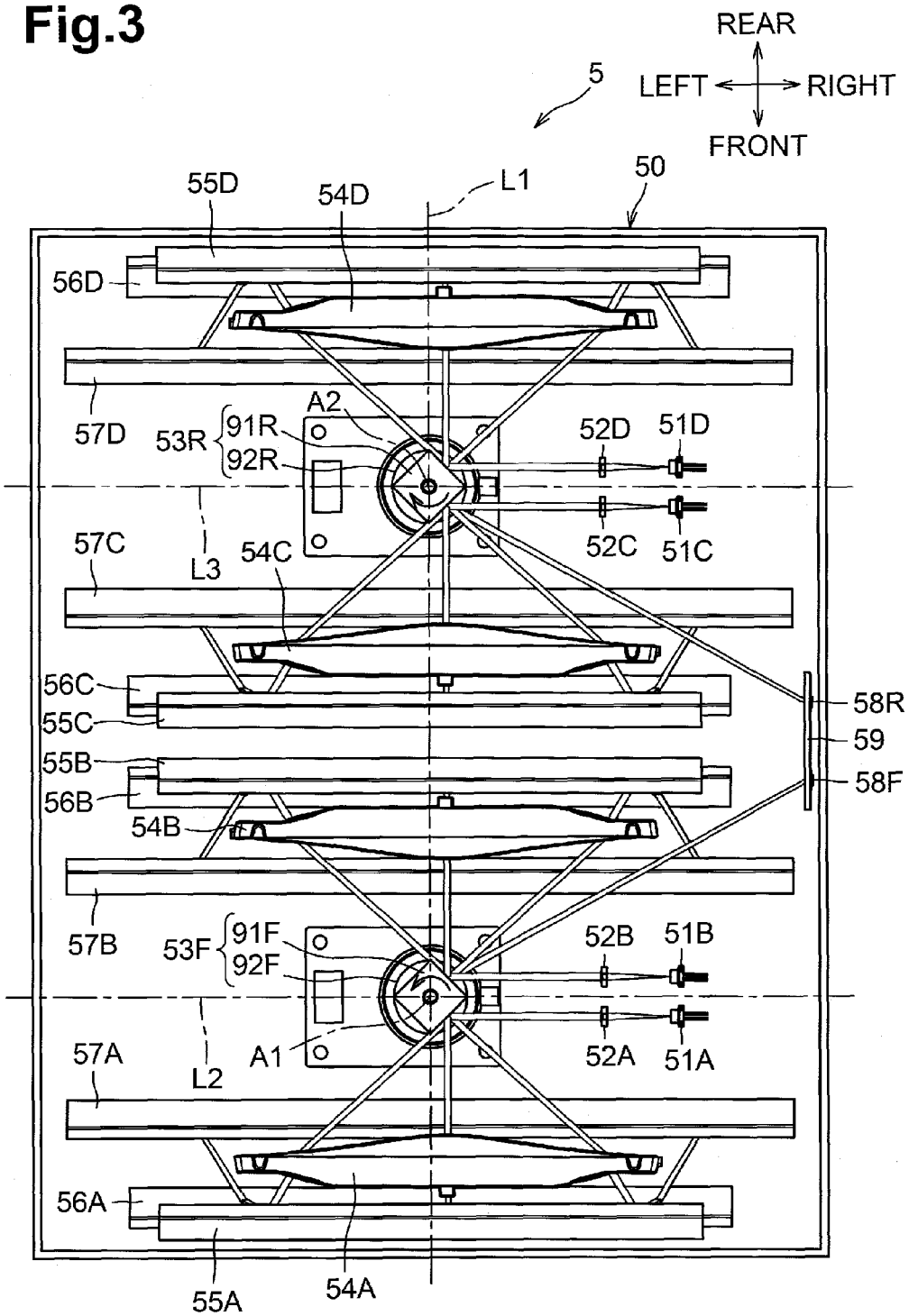
FIG. 3 is a plan view of the optical scanning device in the first embodiment according to one or more aspects of the disclosure.
Figure 4:
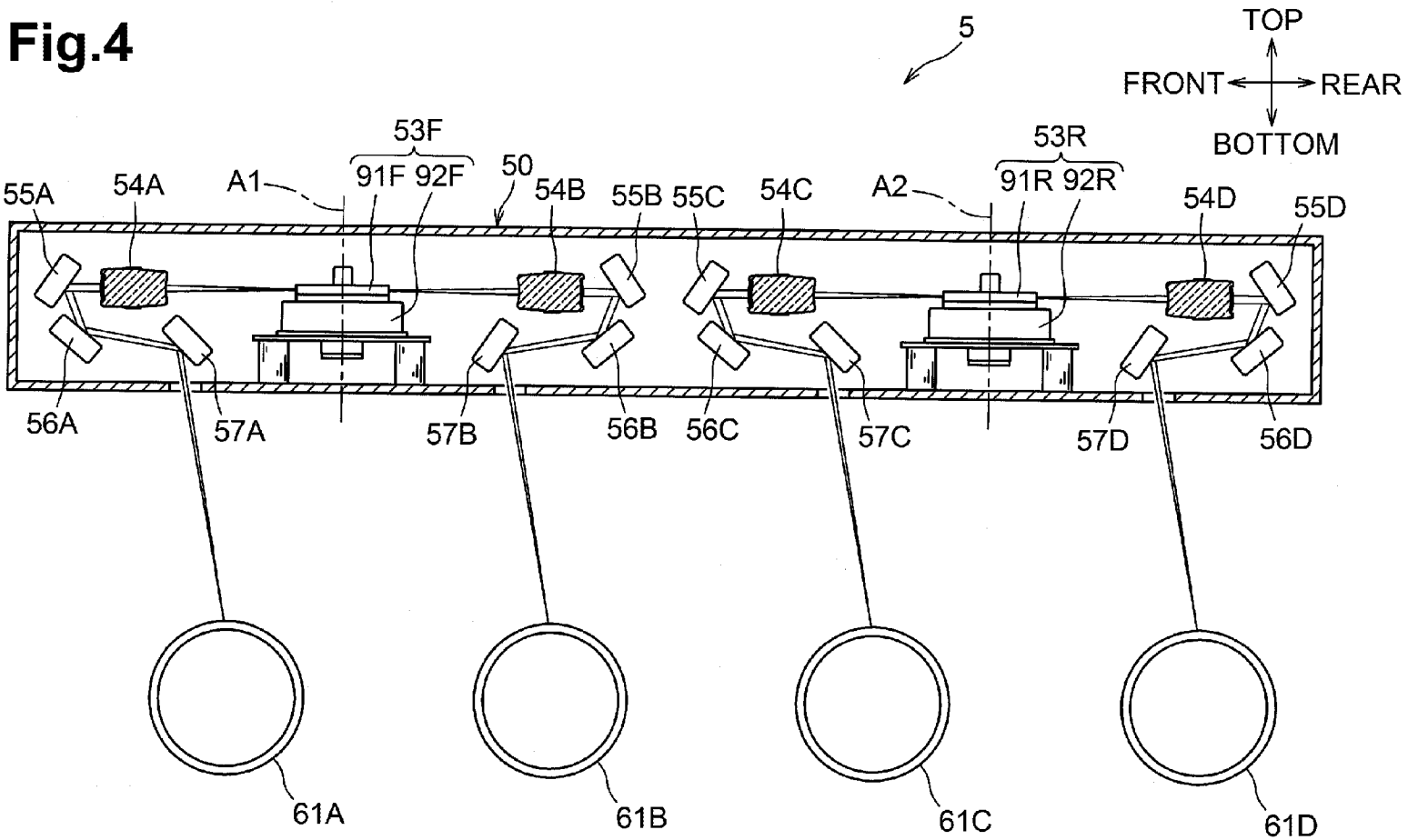
FIG. 4 is a cross-sectional view of the optical scanning device in the first embodiment according to one or more aspects of the disclosure.

Note that in the description in the present specification and in the drawings, the deflector 53 and light detector 58 and so forth disposed in the front half of the optical scanning device 5 will be designated by appending an "F" to the reference numerals, and the deflector 53 and light detector 58 and so forth disposed in the rear half of the device 5 will be designated by appending an "R" to the reference numeral, as shown in FIGS. 3 and 4. The photosensitive drums 61 also are appended by the letters A, B, C, and D, in the order in which they are arranged from the front, and the individual semiconductor lasers 51, coupling lenses 52, scanning lenses 54, and mirrors 55 through 57 are identified by appending the letters A, B, C, and D, corresponding to the relevant photosensitive drums 61A, 61B, 61C, and 61D to be exposed.

In the following description, a main scanning direction refers to a scanning direction of the light beams on the photosensitive drums 61, and the main scanning direction is parallel to a longitudinal direction of each of the scanning lenses 54 and mirrors 55 through 57. A sub-scanning direction is a direction perpendicular to both the main scanning direction and an optical axis of a light beam emitted toward each of the deflectors 53.

Each of the semiconductor lasers 51 (51A through 51D) is configured to emit light (laser light) to be scanned on the corresponding photosensitive drum 61, as illustrated in FIG. 3. The semiconductor laser 51B is an example of a first light source, and the semiconductor laser 51C is an example of a second light source.

Each of the coupling lenses 52 (52A through 52D) is a lens which converts laser light emitted from the corresponding semiconductor laser 51 into a generally linear light beam, and to project the light beam onto a mirror facet of a corresponding polygon mirror 91 in the sub-scanning direction, as will be described later.

The semiconductor lasers 51A and 51B, and the coupling lenses 52A and 52B, are disposed arrayed in the left-right direction at a front right position within the frame 50, with a set of the semiconductor laser 51A and coupling lens 52A, and a set of the semiconductor laser 51B and coupling lens 52B being arrayed in the front-rear direction. Also, the semiconductor lasers 51C and 51D, and the coupling lenses 52C and 52D, are disposed arrayed in the left-right direction at a rear right position within the frame 50, with a set of the semiconductor laser 51C and coupling lens 52C, and a set of the semiconductor laser 51D and coupling lens 52D being arrayed in the front-rear direction.

The deflectors 53 (53F and 53R) are configured to deflect light emitted from the semiconductor lasers 51 and scan the deflected light across the surfaces of the photosensitive drums 61. Each deflector 53 primarily includes a polygon mirror 91 and a driving motor 92. The polygon mirror 91 is a member to deflect light from the semiconductor laser 51, and has generally square shapes in plan view. Four mirror facets, shown without reference numerals, are equidistantly situated from a rotation axis (axis A1 or A2) of the driving motor 92 which rotates the polygon mirror 91 on the axis A1 or A2. In each deflector 53, the polygon mirror 91 rotates at a constant speed and reflects the light (light beam) emitted from the corresponding semiconductor laser 51, thereby deflecting the light (light beam) in the main scanning direction.

The deflector 53F is disposed toward the front of the frame and around the middle in the left-right direction. The deflector 53F is opposite to the semiconductor lasers 51A and 51B relative to the coupling lenses 52A and 52B. The deflector 53R is disposed toward the rear of the frame and around the middle in the left-right direction. The deflector 53R is opposite to the semiconductor lasers 51C and 51D relative to the coupling lenses 52C and 52D. The axis A2 is generally parallel to the axis A1.

The polygon mirror 91F of the deflector 53F and the polygon mirror 91R of the deflector 53R are configured to rotate in opposite directions. In other words, the driving motor 92F of the deflector 53F and the driving motor 92R of the deflector 53R are configured to drive the polygon mirrors 91F and 91R, respectively, to rotate in opposite directions.

The polygon mirror 91F of the deflector 53F and the polygon mirror 91R of the deflector 53R are disposed equidistantly from an inner bottom face of the frame 50, when viewed in the main scanning direction (left-right direction), as illustrated in FIG. 4. The deflectors 53F and 53R are fixed to the inner bottom face of the frame 50. That is to say, the polygon mirrors 91F and 91R are disposed at the same height when viewed in the main scanning direction. In other words, the polygon mirrors 91F and 91R are disposed on a same plane perpendicular to the axes A1 and A2.

Note here that the deflector 53F is an example of a first deflector, the polygon mirror 91F is an example of a first deflecting member, and the driving motor 92F is an example of a first driver. Also, the deflector 53R is an example of a second deflector, the polygon mirror 91R is an example of a second deflecting member, and the driving motor 92R is an example of a second driver. The axis A1 is an example of a first axis, and the axis A2 is an example of a second axis.

Each of the scanning lenses 54 (54A through 54D) is a lens through which the light beam deflected by the corresponding polygon mirror 91 pass. In further detail, the scanning lens 54 has a function to project the light beam onto the surface of the corresponding photosensitive drum 61 as spots, and to correct mirror facet angle error of the corresponding polygon mirror 91. The scanning lens 54 also has fθ properties such that the light beam deflected at a constant angular speed by the polygon mirror 91 is scanned across the surface of the photosensitive drum 61 at a constant speed. The scanning lens 54A is disposed toward the front of the deflector 53F, and the scanning lens 54B is disposed toward the rear of the deflector 53F. The scanning lens 54C is disposed toward the front of the deflector 53R, and the scanning lens 54D is disposed toward the rear of the deflector 53R.

The mirrors 55 through 57 are members to reflect the light beam, which has passed through the scanning lens 54, toward the photosensitive drum 61. The mirrors 55 through 57 are formed by vapor deposition of a material with high reflectivity, such as aluminum, upon a glass plate, for example. Each of the mirrors 55 (55A through 55D) is disposed on an opposite side of the corresponding scanning lens 54 from the corresponding polygon mirror 91, and reflects the light beam, which have passed through the scanning lens 54, toward the corresponding mirror 56. Each of the mirrors 56 (56A through 56D) is disposed below the corresponding mirror 55 and reflects the light beam reflected at the mirror 55 toward the corresponding mirror 57. Further, each of the mirrors 57 (57A through 57D) is disposed facing the corresponding mirror 56 and reflects the light beam reflected at the mirror 56 toward the corresponding photosensitive drum 61.

The light detectors 58 (58F, 58R) illustrated in FIG. 3 are configured to detect the light beams deflected by the deflectors 53 (53F, 53R), respectively. In the optical scanning device 5 (laser printer 1), each of the semiconductor lasers 51 is controlled to start blinking based on image data, after a predetermined time has elapsed since the detection of the light beam by the corresponding light detector 58. Accordingly, the image write start positions on the photosensitive drums 61 can be aligned. The light detector 58F is used for aligning the image write start positions on the photosensitive drums 61A and 64B, and the light detector 58R is used for aligning the image write start positions on the photosensitive drums 61C and 64D. Detailed control and configurations for aligning the write start positions are known, so description thereof will be omitted in the present specification.

As viewed in the axial direction (vertical direction) along the axes A1 and A2, the light detectors 58F and 58R are both disposed on the right side relative to a first line L1 passing through the axes A1 and A2, and between a second line L2 and a third line L3. The light detectors 58F and 58R are arrayed in the front-rear direction. The second line L2 passes through the axis A1 and is perpendicular to the first line L1, and the third line L3 passes through the axes A2 and is perpendicular to the first line L1. In other words, the light detectors 58F and 58R are disposed on one side (upstream side) in the main scanning direction relative to the axes A1 and A2 and between the axis A1 and the axis A2 in the sub-scanning direction.

In addition, the light detector 58F and light detector 58R are disposed on a same circuit board 59. In further detail, the light detectors 58F and 58R are fixed to the circuit board 59, on a side thereof opposite from the side that the light beams enter, such that photoreceptors of the light detectors 58F and 58R face the light beams via through holes (not shown) formed in the circuit board 59. The circuit board 59 extends perpendicular to the main scanning direction in which the light beams are scanned on the photosensitive drums 61

Figure 5:
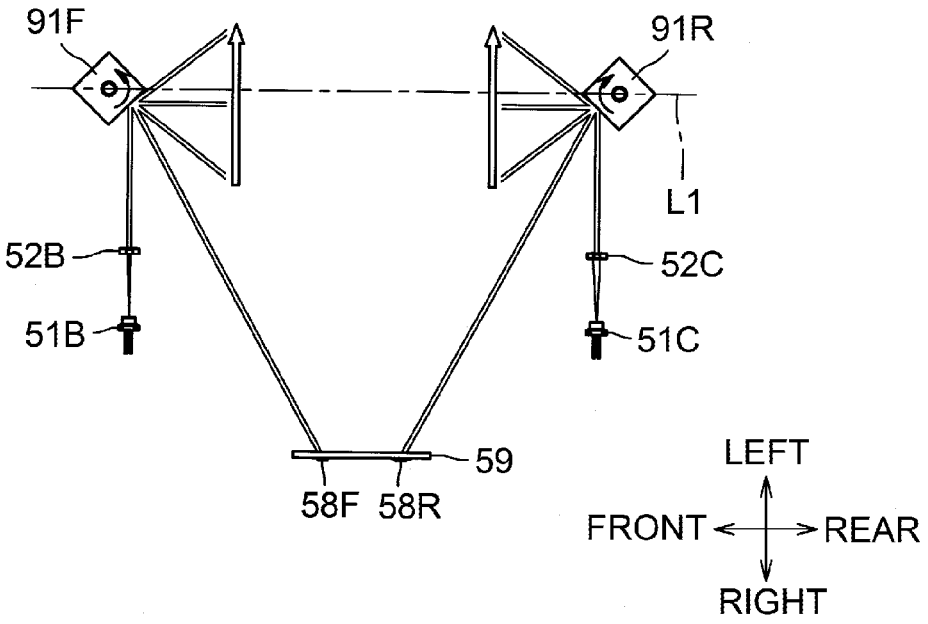
FIG. 5 is a diagram illustrating effects of the optical scanning device in the first embodiment according to one or more aspects of the disclosure.

Next, the effects of the above optical scanning device 5 will be described. As illustrated in FIG. 5, the polygon mirrors 91F and 91R of the optical scanning device 5 rotate in opposite directions to each other, so the light beam scanning directions (main scanning direction) indicated by the outlined arrows are the same. The light detectors 58F and 58R are disposed upstream in the light beam scanning directions to improve the precision of the image write start timing. In this case, both of the light detectors 58F and 58R can be disposed on the right side relative to the line L1, and further, the light detectors 58F and 58R can be disposed in close proximity to each other.

Thus, the number of circuit boards can be reduced by disposing the light detectors 58F and 58R on the same circuit board 59, which can contribute to reduction of the number of parts of the optical scanning device 5, and reduction in costs and size thereof. Moreover, reducing the number of circuit boards enables the wiring structure connected to the circuit board to be simplified, so the configuration of the optical scanning device 5 can be simplified.

The polygon mirrors 91F and 91R of the optical scanning device 5 are configured to rotate in opposite directions, so the light beams deflected at the polygon mirrors 91F and 91R directly enter the respective light detectors 58F and 58R, without a mirror or the like. Accordingly, the number of parts can be reduced, and the configuration of the optical scanning device 5 can be simplified. Further, reducing the number of parts and simplifying the configuration enable the costs and size of the optical scanning device 5 to be reduced. Moreover, the optical path length of the light beam to be detected by the light detector 58F and that of the light beam to be detected by the light detector 58R are the same.

Figure 6:
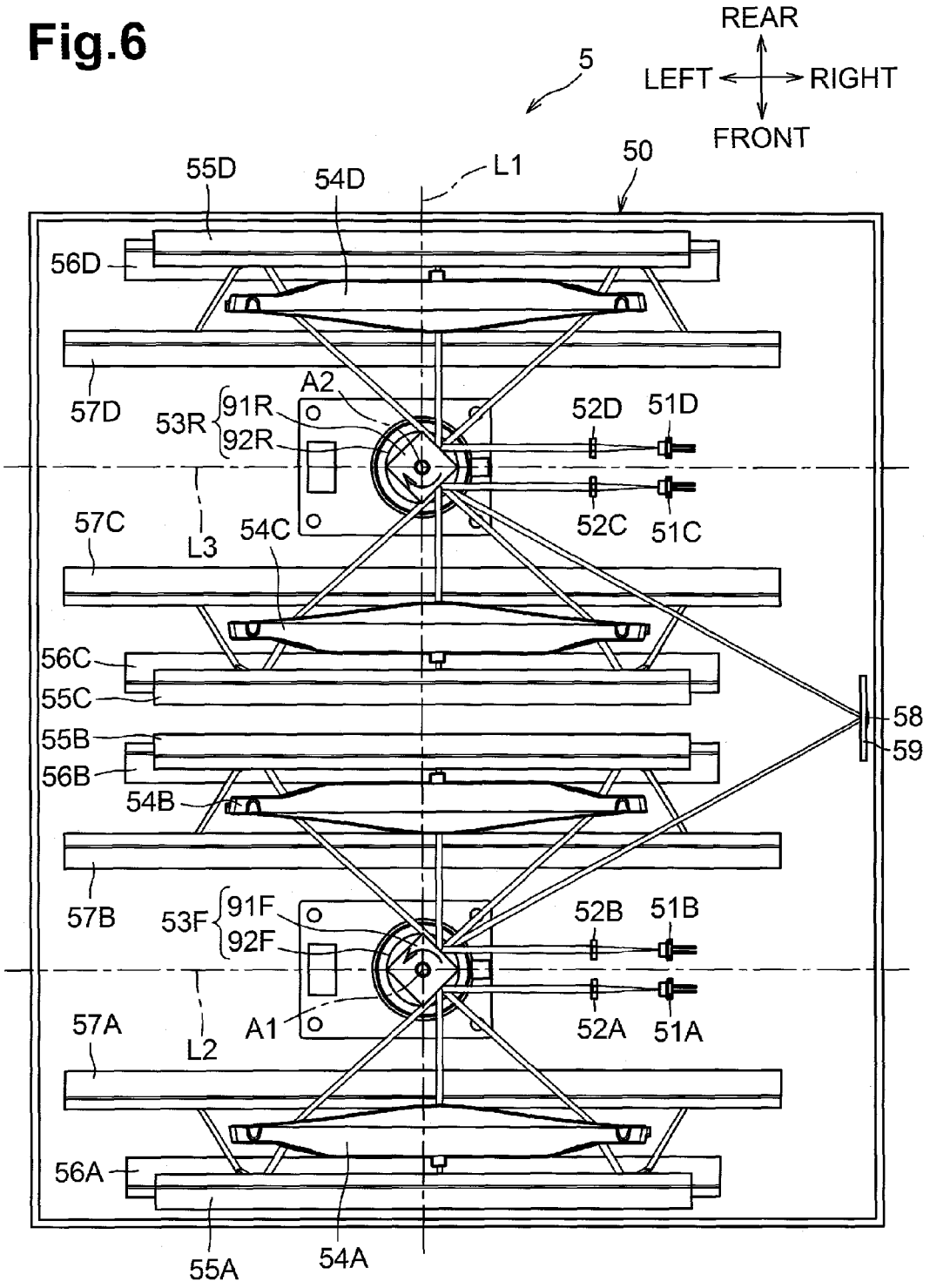
FIG. 6 is a plan view of an optical scanning device in a modification of the first embodiment according to one or more aspects of the disclosure.

Note that in the above-described embodiment, the light detector 58F is described as an example of a first light detector, and the light detector 58R is described as an example of a second light detector. That is, the optical scanning device 5 is described as having two light detectors 58F and 58R that constitute a light detecting unit. However, the present invention is not restricted to this arrangement, and a configuration may be made such as illustrated in FIG. 6, where instead of two light detectors, a single light detector 58 (light detecting unit) capable of detecting both the light beam deflected by the deflector 53F and the light beam deflected by the deflector 53R is provided on the circuit board 59. The light detector 58 is configured to distinguish between the light beam deflected by the deflector 53F and the light beam deflected by the deflector 53R based on the incident directions of the light beams. The use of such light detector 58 enables alignment of the image write start positions on the photosensitive drums 61.

Having a single light detector 58 enables the number of parts of the optical scanning device 5 to be reduced, and costs to be reduced, as compared to a configuration having a plurality of light detectors. This enables the number of circuit boards to be reduced and the size of a circuit board to be reduced, and the wiring structure to be simplified as compared to a configuration having a plurality of light detectors, so the size of the optical scanning device 5 can be reduced, and the configuration thereof can be simplified.

Second Embodiment

Next, a second embodiment will be described. While there are some differences in placement and shapes and so forth, parts which are the same as or equivalent to those in the above-described embodiment will be denoted by the same reference numerals, and detailed description thereof will be omitted as appropriate.

Figure 7:
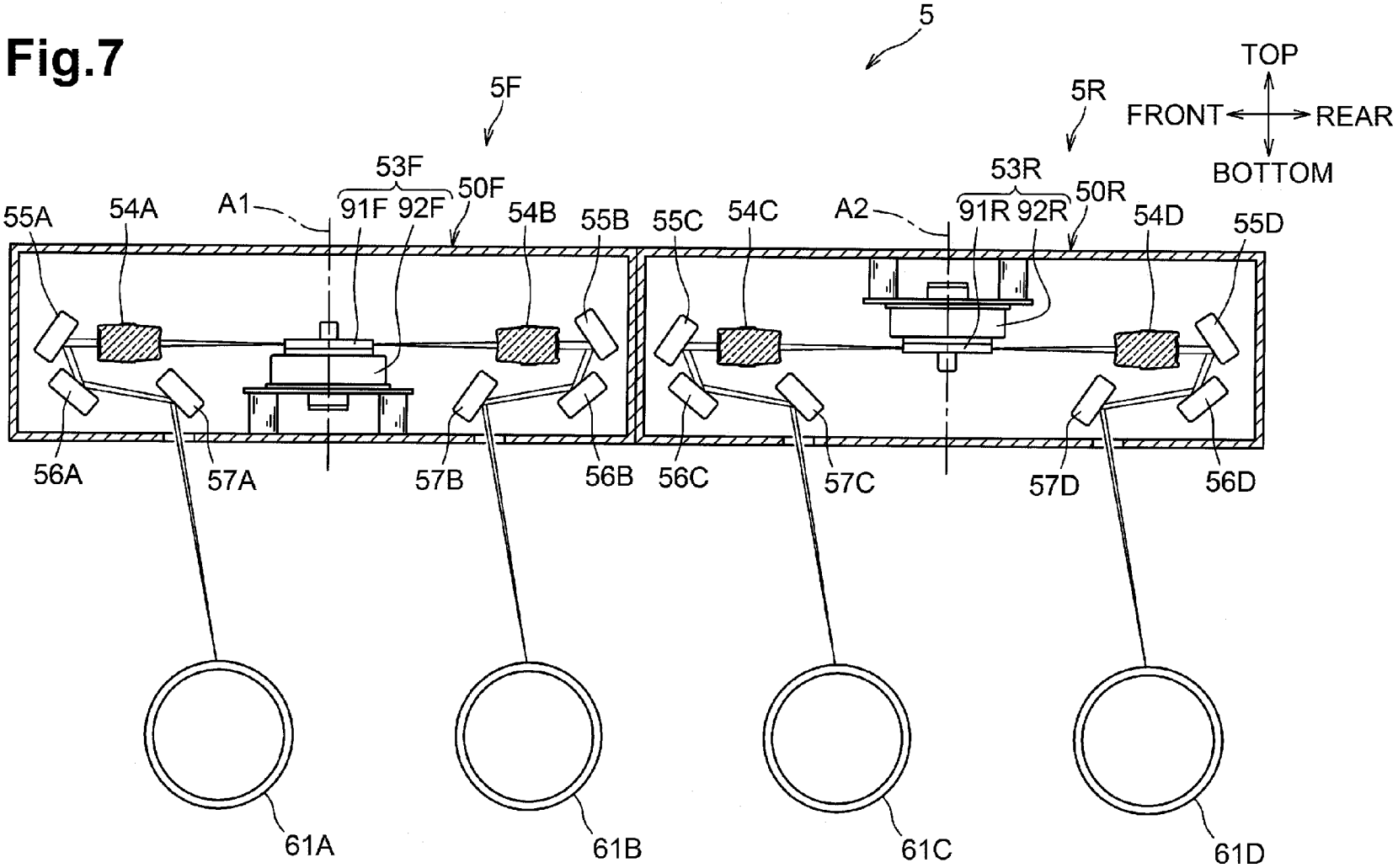
FIG. 7 is cross-sectional view of an optical scanning device in a second embodiment according to one or more aspects of the disclosure.
Figure 8:
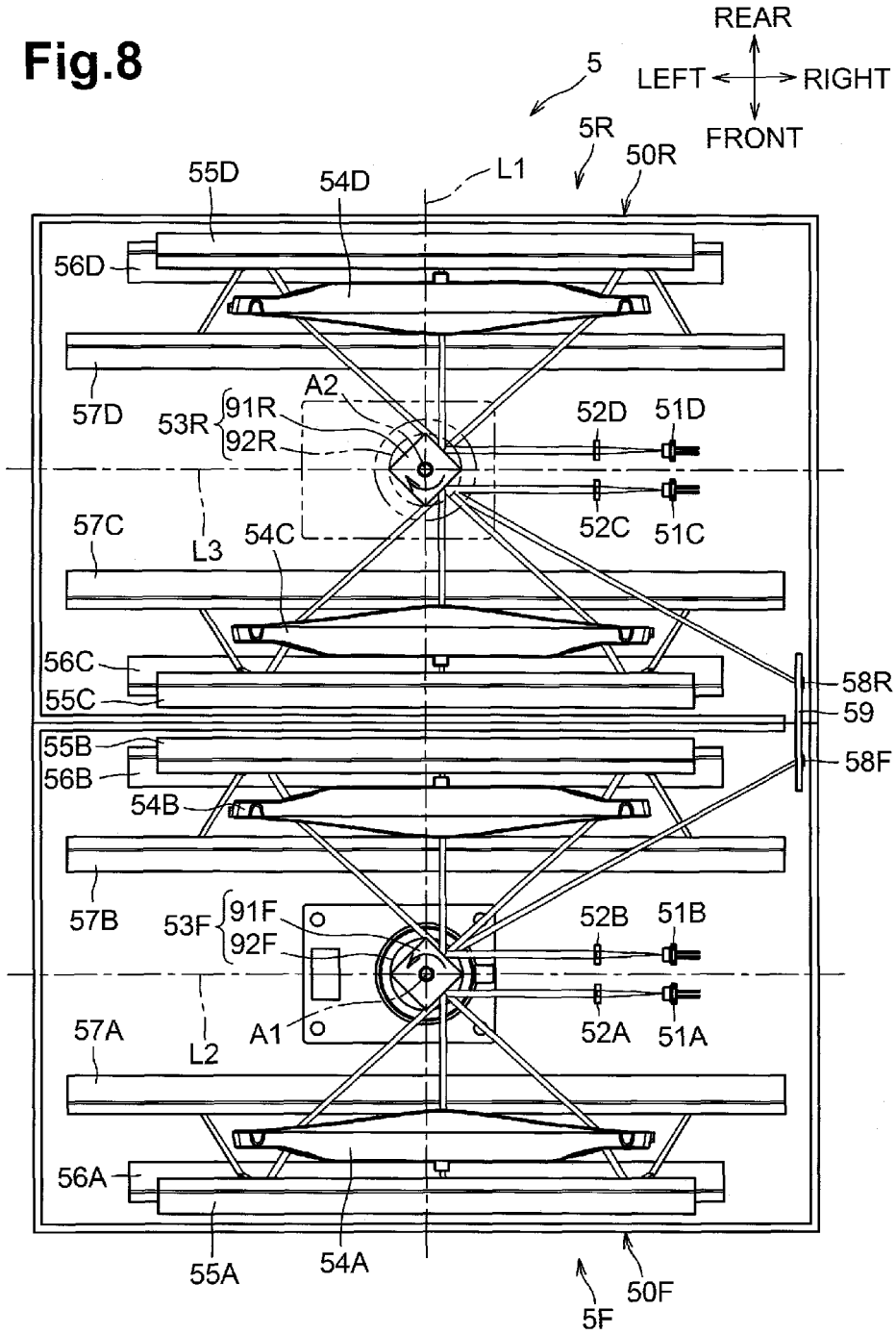
FIG. 8 is a plan view of the optical scanning device in the second embodiment according to one or more aspects of the disclosure.

The deflector 53F and deflector 53R of the optical scanning device 5 according to the second embodiment are installed so as to be vertically inverted one from another, as illustrated in cross-sectional view in FIGS. 7 and 8. More specifically, the deflector 53F is installed such that the driving motor 92F is disposed on the lower side of the polygon mirror 91F, whereas the deflector 53R is installed such that the driving motor 92R is disposed on the upper side of the polygon mirror 91R. In other words, the deflector 53F and the deflector 53R are oriented inversely to each other in the axial direction along the axes A1 and A2.

By disposing the deflector 53F and deflector 53R so as to be vertically inverted one from another, a configuration can be realized where the polygon mirrors 91F and 91R rotate in opposite directions from each other even if the driving motors 92F and 92R are only capable of rotating in one direction. That is to say, a configuration can be realized where the polygon mirrors 91F and 91R rotate in opposite directions from each other even if the deflectors 53F and 53R are the same parts. Thus, costs related to parts management can be reduced, for example. Also, a configuration where driving motors 92F and 92R only capable of rotating in one direction are used can reduce the costs of the deflectors 53F and 53R as compared to a case where driving motors capable of rotating in both directions are used. As a result, costs for the optical scanning device 5 can be further reduced.

Also, the polygon mirrors 91F and 91R of the present embodiment are situated on the same plane perpendicular to the axes A1 and A2, in the same way as with the optical scanning device 5 according to the first embodiment described above (see FIG. 4), so the optical parts such as the scanning lenses 54 and the mirrors 55 through 57 may be disposed in the same way as with the above-described first embodiment.

Figure 9:
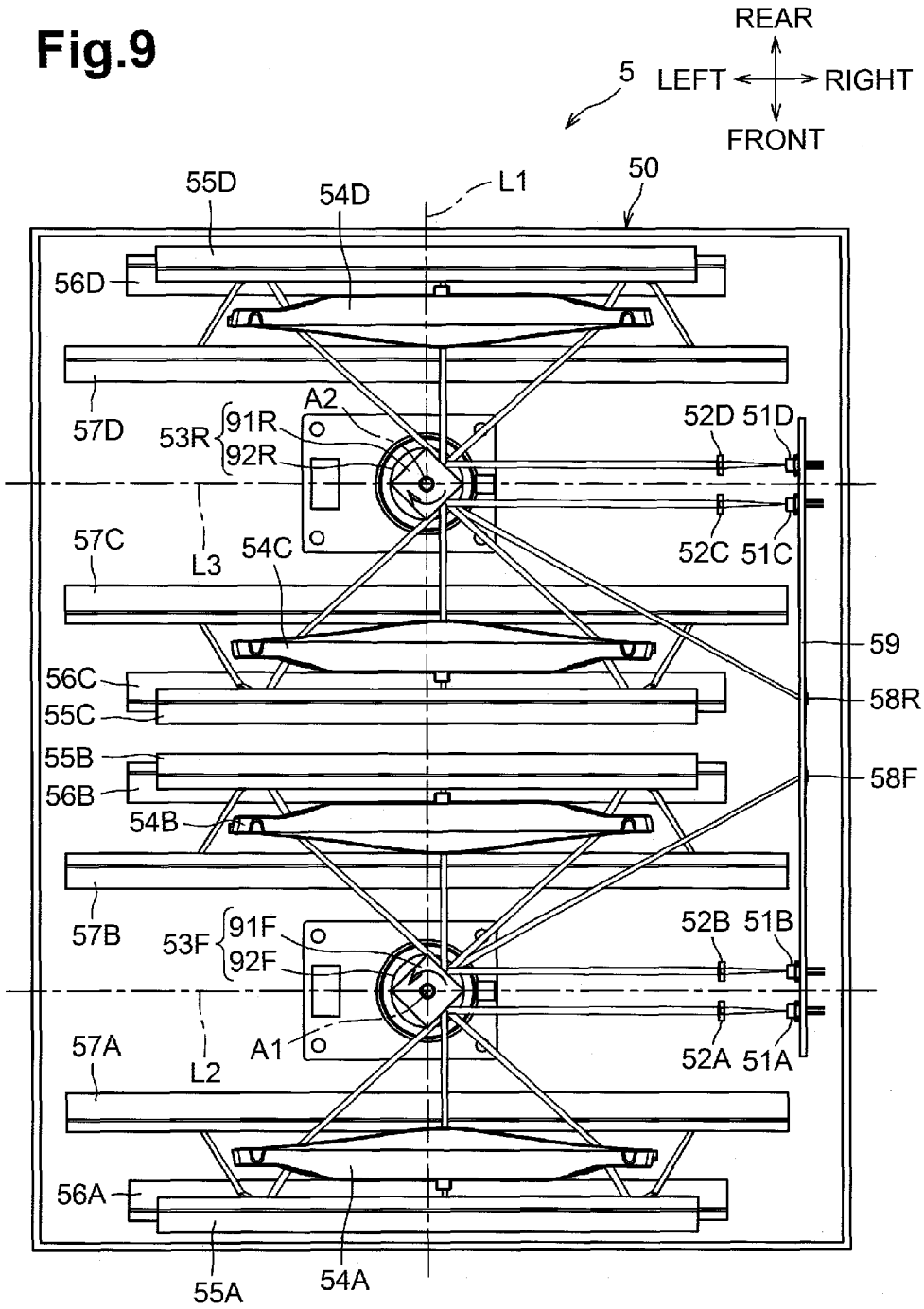
FIG. 9 is a plan view of an optical scanning device in a third embodiment according to one or more aspects of the disclosure.

Now, while the optical scanning device 5 according to the above first embodiment has been described as comprising the optical parts, such as the semiconductor lasers 51A through 51D, deflectors 53F and 53R, and light detectors 58F and 58R, being disposed within a single box-shaped frame 50 as illustrated in FIG. 3, the present invention is not restricted to this arrangement. The optical scanning device 5 may comprise a plurality of scanning units, e.g., a first scanning unit 5F and a second scanning unit 5R as illustrated in FIGS. 8 and 9.

Specifically, the first scanning unit 5F and second scanning unit 5R are disposed arrayed in the front-rear direction. The first scanning unit 5F is configured primarily including the semiconductor lasers 51A and 51B, the coupling lenses 52A and 52B, the deflector 53F, the scanning lenses 54A and 54B, the mirrors 55A, 55B, 56A, 56B, 57A, and 57B, and the light detector 58F, within the box-shaped frame 50F. In the same way, second scanning unit 5R is configured primarily including the semiconductor lasers 51C and 51D, the coupling lenses 52C and 52D, the deflector 53R, the scanning lenses 54C and 54D, the mirrors 55C, 55D, 56C, 56D, 57C, and 57D, and the light detector 58R, within the box-shaped frame 50R.

Third Embodiment

Next, a third embodiment will be described. The optical scanning device 5 according to the third embodiment has the semiconductor lasers 51A through 51D and the light detectors 58F and 58R provided on the same circuit board 59, as illustrated in FIG. 9. More specifically, the circuit board 59 is formed having a long shape along the right side wall of the box-shaped frame 50, with the semiconductor lasers 51A and 51B, light detectors 58F and 58R, and semiconductor lasers 51C and 51D, arrayed in this order from the front, and fixed to the circuit board 59.

According to the present embodiment, the number of circuit boards can be minimized as compared to a configuration where the semiconductor lasers 51A through 51D and the light detectors 58F and 58R are disposed on separate circuit boards. Accordingly, further reduction in the number of parts, and reduction in costs and size of the optical scanning device 5 can be realized. Also minimizing the number of circuit boards further simplifies the wiring structure, so the configuration of the optical scanning device 5 can be further simplified.

Figure 10:
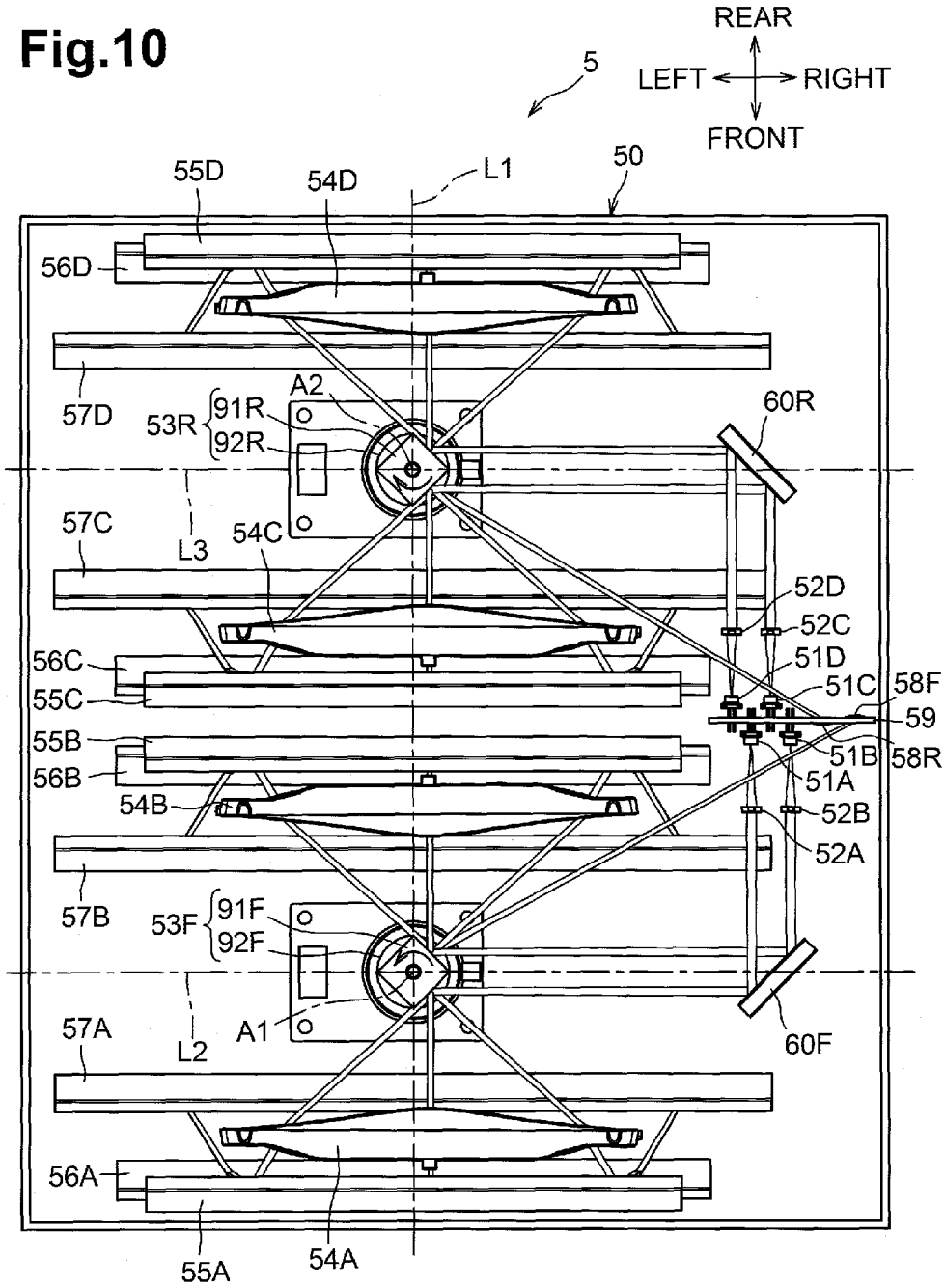
FIG. 10 is a plan view of an optical scanning device in a modification of the third embodiment according to one or more aspects of the disclosure.

Note that the configuration of providing the semiconductor lasers 51 and light detectors 58 to the same circuit board 59 is not restricted to the configuration illustrated in FIG. 9. For example, an arrangement may be made such as illustrated in FIG. 10, where the circuit board 59 is disposed along the main scanning direction, toward the right of the frame 50, and around the middle in the front-rear direction. The semiconductor lasers 51A and 51B, and the light detector 58R are arrayed in this order from the left on the front face of the circuit board 59, and the semiconductor lasers 51C and 51D, and the light detector 58F are arrayed in this order from the left on the rear face.

According to a modification illustrated in FIG. 10, minimizing the number of circuit boards further simplifies the wiring structure, so the configuration of the optical scanning device 5 can be further simplified, in the same way as in the embodiment illustrated in FIG. 9. In addition, the spacing between the semiconductor lasers 51 can be narrowed as compared to a configuration where all semiconductor lasers 51 are disposed on the same face of the circuit board 59 as illustrated in FIG. 9, so the size of the circuit board 59 can be reduced.

Figure 11:
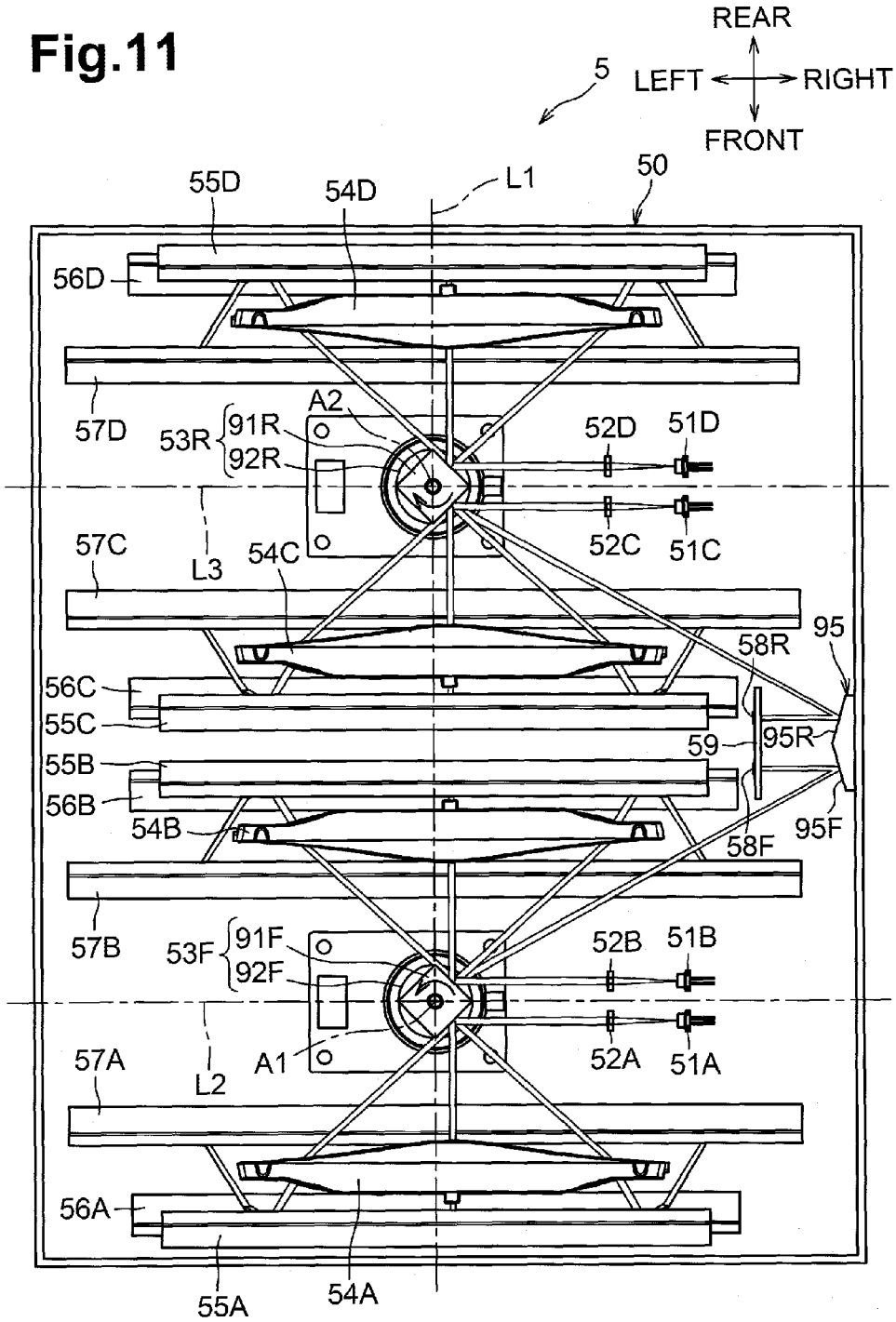
FIG. 11 is a plan view of an optical scanning device in a fourth embodiment according to one or more aspects of the disclosure.

As supplemental information, the optical scanning device 5 illustrated in FIG. 11 has mirrors 60F and 60R disposed to the right of the deflectors 53F and 53R so as to face the deflectors 53F and 53R respectively, to reflect light beams. The coupling lenses 52A and 52B are disposed between the front face of the circuit board 59 and mirror 60F so as to face the semiconductor lasers 51A and 51B respectively, and the coupling lenses 52C and 52D are disposed between the rear face of the circuit board 59 and mirror 60R so as to face the semiconductor lasers 51C and 51D respectively.

Laser light emitted from the semiconductor lasers 51A and 51B are converted into light beams at the coupling lenses 52A and 52B and are reflected at the mirror 60F, and enter the deflector 53F. The light beam deflected at the deflector 53F is detected by the light detector 58F. In the same way, laser light emitted from the semiconductor lasers 51C and 51D are converted into light beams at the coupling lenses 52C and 52D and are reflected at the mirror 60R, and enter the deflector 53R. The light beam deflected at the deflector 53R is detected by the light detector 58R.

Fourth Embodiment

Next, a fourth embodiment will be described. The optical scanning device 5 according to the fourth embodiment further includes a mirror member 95, in addition to the semiconductor lasers 51A through 51D, the deflectors 53F and 53R, and the circuit board 59 where the light detectors 58F and 58R are provided, as illustrated in FIG. 11. The mirror member 95 is disposed at the right side of the frame 50 and around the middle in the front-rear direction. The circuit board 59 is disposed to the left of the mirror member 95 so as to face the mirror member 95.

The mirror member 95 has a generally pentagon shape in plan view, has a first mirror facet 95F for reflecting a light beam deflected by the deflector 53F toward the light detector 58F, and a second mirror facet 95R for reflecting a light beam deflected by the deflector 53R toward the light detector 58R. The first mirror facet 95F is formed such that the reflected light beam enters the photoreceptor of the light detector 58F perpendicularly, and the second mirror facet 95R is formed such that the reflected light beam enter the photoreceptor of the light detector 58R perpendicularly, parallel to the light beam reflected by the first mirror facet 95F.

In the present embodiment, the light beams deflected by the deflectors 53F and 53R enter the photoreception faces of the light detectors 58F and 58R respectively at the same incident angle, so the light detectors 58F and 58R can be easily arrayed adjacently. This enables the circuit board 59 to be used in common and to be reduced in size, so the configuration of the optical scanning device 5 can be simplified and reduced in size. Also, the light beams enter the photoreception faces of the corresponding light detectors 58F and 58R at the same indent angle, whereby the detection precision of light can be improved.

Figure 12:
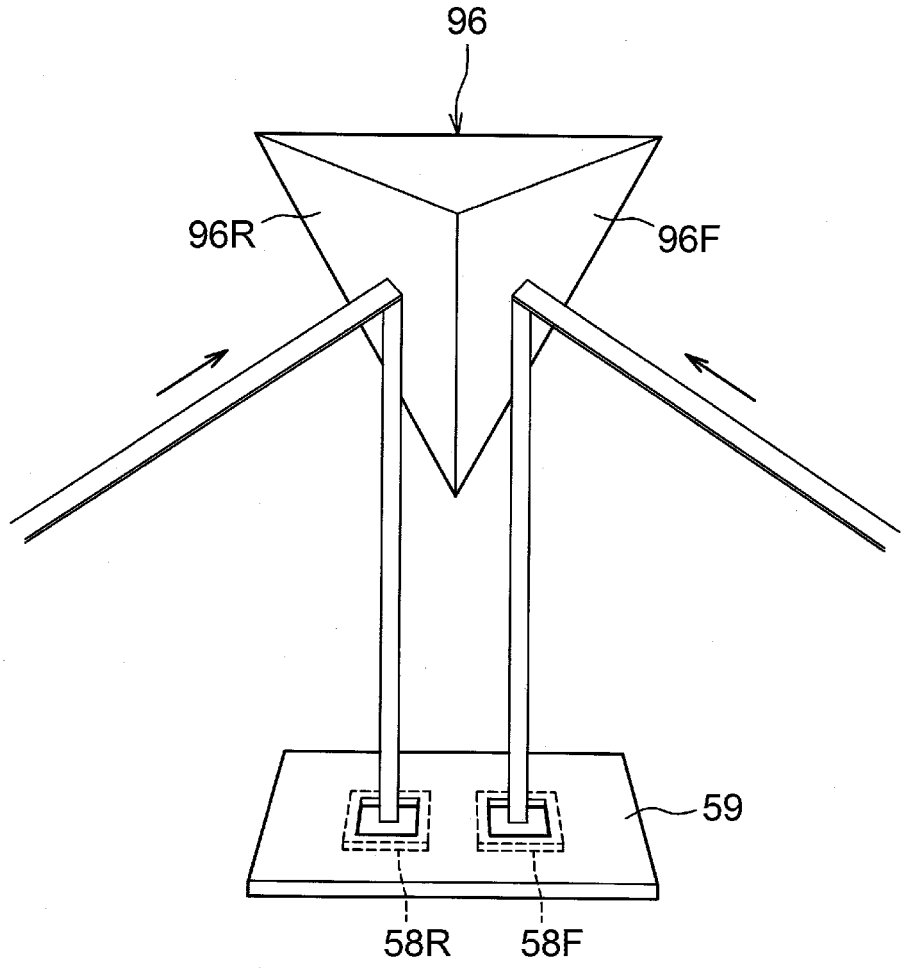
FIG. 12 is a perspective view of an optical scanning device in a modification of the fourth embodiment according to one or more aspects of the disclosure.

Note that the configuration of the mirror member and the placement of the circuit board are not restricted to the embodiment illustrated in FIG. 11. For example, a mirror member 96 may be formed as a tetrahedron having a first mirror facet 96F and a second mirror facet 96R, with the circuit board 59 being disposed below the mirror member 96 so as to face the mirror member 96, as illustrated in FIG. 12. The first mirror facet 96F is formed so as to reflect an incident light beam downwards such that the light beam enters the photoreceptor of the light detector 58F perpendicularly. The second mirror facet 96R is formed so as to reflect an incident light beam downwards such that the light bema enters the photoreceptor of the light detector 58R perpendicularly, parallel to the light beam reflected by the first mirror facet 96F.

The modification illustrated in FIG. 12 enables the configuration of the optical scanning device 5 to be simplified and size reduced, and light detection precision to be improved, in the same way as in the embodiment illustrated in FIG. 11. This arrangement also enables the freedom of placement of the circuit board 59 within the optical scanning device 5 to be improved.

While the modification illustrated in FIG. 12 is of a configuration where the mirror member 96 reflects the light beams downwards, the present invention is not restricted to this, and the mirror member 96 may reflect the light beams upwards, for example. Also, while the mirror member 95 illustrated in FIG. 11 has the first mirror facet 95F and the second mirror facet 95R, and the mirror member 96 illustrated in FIG. 12 has the first mirror facet 96F and the second mirror facet 96R, the present invention is not restricted to this arrangement. For example the optical scanning device may be of a configuration including a first mirror member having a first mirror facet and a second mirror member having a second mirror facet, i.e., including two mirror members.

Although, in the above-described embodiments, the semiconductor laser 51 having a single luminous point is exemplified as the light source, the present invention is not restricted to this. For example, the light source may have a plurality of luminous points.

Although, in the above-described embodiments, the polygon mirror 91 which has four mirror facets and is generally square in plan view is exemplified as a deflecting member of the deflector 53, the present invention is not restricted to this. For example, the deflector may have a polygon mirror which has six mirror facets and is generally hexagonal in plan view.

Although, in the above-described embodiments, the optical scanning device is used in an image forming apparatus such as the laser printer 1, the present invention is not restricted to this, and may be used in an measurement apparatus, an inspection apparatus, and so forth.

While the disclosure has been described in detail with reference to the specific embodiments thereof, various changes, arrangements and modifications may be applied therein without departing from the spirit and scope of the disclosure.

What is claimed is:

1. An optical scanning device comprising:

a first light source configured to emit first light;

a second light source configured to emit second light;

a first deflector comprising:

a first deflecting member configured to deflect the first light to scan the deflected first light; and a first driver configured to drive the first deflecting member to rotate about a first axis in a first rotation direction;

a second deflector comprising:

a second deflecting member configured to deflect the second light to scan the deflected second light; and a second driver configured to drive the second deflecting member to rotate about a second axis in a second rotation direction, the second axis being parallel to the first axis, and the second rotation direction being opposite to the first rotation direction; and a light detecting unit configured to detect the first light deflected by the first deflecting member and the second light deflected by the second deflecting member, wherein as viewed in an axial direction along the first axis and the second axis, the light detecting unit is disposed on one side relative to a first line and between a second line and a third line, the first line passing through the first axis and the second axis, the second line passing through the first axis and perpendicular to the first line, and the third line passing through the second axis and perpendicular to the first line.

2. The optical scanning device according to claim 1, wherein the light detecting unit comprises a first light detector configured to detect the first light deflected by the first deflecting member, and a second light detector configured to detect the second light deflected by the second deflecting member.

3. The optical scanning device according to claim 2, further comprising:

a first mirror facet configured to reflect the first light deflected by the first deflecting member in a first reflecting direction to the first light detector; and a second mirror facet configured to reflect the second light deflected by the second deflecting member in a second reflecting direction to the second light detector, the second reflecting direction being parallel to the first reflecting direction.

4. The optical scanning device according to claim 1, further comprising a circuit board on which the light detecting unit is mounted.

5. The optical scanning device according to claim 4, wherein the first light source and the second light source are mounted on the circuit board.

6. The optical scanning device according to claim 4, wherein the first deflecting member is configured to scan the deflected first light in a main scanning direction, and the second deflecting member is configured to scan the deflected second light in the main scanning direction, and the circuit board extends perpendicular to the main scanning direction.

7. The optical scanning device according to claim 1, wherein the first deflector and the second deflector are oriented inversely to each other in the axial direction.

8. The optical scanning device according to claim 7, wherein the first driver comprises a first motor, and the second driver comprises a second motor which is the same as the first motor.

9. The optical scanning device according to claim 1, wherein the first deflecting member comprises a polygon mirror, and the second deflecting member comprises a polygon mirror.

10. The optical scanning device according to claim 1, wherein the first deflector, the second deflector, and the light detecting unit are arranged such that the light detecting unit directly receives the first light deflected by the first deflecting member and the second light deflected by the second deflecting member.

11. An optical scanning device comprising:

a first light source configured to emit first light;

a second light source configured to emit second light;

a first deflector comprising:

a first deflecting member configured to deflect the first light to scan the deflected first light in a main scanning direction; and a first driver configured to drive the first deflecting member to rotate about a first axis in a first rotation direction;

a second deflector comprising:

a second deflecting member configured to deflect the second light to scan the deflected second light in the main scanning direction; and a second driver configured to drive the second deflecting member to rotate about a second axis in a second rotation direction, the second axis being parallel to the first axis, and the second rotation direction being opposite to the first rotation direction; and a light detecting unit configured to detect the first light deflected by the first deflecting member and the second light deflected by the second deflecting member, wherein the light detecting unit is disposed on one side in the main scanning direction relative to the first axis and the second axis, and between the first axis and the second axis in a sub-scanning direction which is perpendicular to the main scanning direction.

12. The optical scanning device according to claim 11, wherein the light detecting unit is disposed on an upstream side in the main scanning direction relative to the first axis and the second axis.

13. The optical scanning device according to claim 11, wherein the light detecting unit comprises a first light detector configured to detect the first light deflected by the first deflecting member, and a second light detector configured to detect the second light deflected by the second deflecting member.

14. The optical scanning device according to claim 11, further comprising a circuit board on which the light detecting unit is mounted.

15. The optical scanning device according to claim 11, wherein the first deflecting member comprises a polygon mirror, and the second deflecting member comprises a polygon mirror.

16. The optical scanning device according to claim 11, wherein the light detecting unit is configured to directly receive the first light deflected by the first deflecting member and the second light deflected by the second deflecting member.

* * * * *